US005135104A

United States Patent [19]

Jorba

[11] Patent Number: 5,135,104

[45] Date of Patent: Aug. 4, 1992

[54] DEVICES FOR THE SUPPORT AND GROUP TRANSPORT OF RECEPTACLES AND CARDBOARD LAMINATES FOR FORMING THE DEVICES

[75] Inventor: José Jorba, Barcelona, Spain

[73] Assignee: Jorba S.A., Barcelona, Spain

[21] Appl. No.: 459,424

[22] Filed: Dec. 29, 1989

[30] Foreign Application Priority Data

| | | | |
|---|---|---|---|
| Apr. 1, 1989 | [ES] | Spain | 8901149 |
| Apr. 3, 1989 | [ES] | Spain | 8901158 |
| Nov. 14, 1989 | [ES] | Spain | 8903867 |

[51] Int. Cl.[5] ..... B65D 71/00

[52] U.S. Cl. ..... 206/151; 206/158; 206/161; 206/427

[58] Field of Search ..... 206/139, 140, 145–151, 206/153, 154, 157–162, 168, 169, 193, 194, 197–199, 427, 430, 431

[56] References Cited

U.S. PATENT DOCUMENTS

| | | | |
|---|---|---|---|
| 2,472,005 | 5/1949 | De Swart | 206/145 |
| 2,834,461 | 5/1958 | Dusseault . | |
| 2,844,245 | 7/1958 | Gruber et al. | 206/158 |
| 3,038,600 | 6/1962 | Powell | 206/158 |
| 3,099,475 | 7/1963 | Manizza . | |
| 3,310,334 | 3/1967 | Murphy . | |
| 3,404,912 | 10/1968 | Watts | 206/158 |
| 3,414,313 | 12/1968 | Schwarz | 206/156 |
| 3,653,503 | 4/1972 | Arneson . | |
| 3,687,281 | 8/1972 | Prot | 206/194 |
| 3,698,550 | 10/1972 | Graser | 206/158 |
| 3,764,001 | 10/1973 | Graser . | |
| 4,192,540 | 3/1980 | Oliff | 206/161 |
| 4,273,273 | 6/1981 | Zenri | 206/145 |
| 4,305,499 | 12/1981 | Mercer . | |
| 4,453,630 | 6/1984 | Helms et al. . | |
| 4,596,356 | 6/1986 | Chaussadas | 206/194 |
| 5,022,525 | 6/1991 | Schuster . | |

FOREIGN PATENT DOCUMENTS

| | | | |
|---|---|---|---|
| 686614 | 5/1964 | Canada . | |
| 0112647 | 12/1968 | Denmark | 206/158 |
| 3711322 | 5/1988 | Fed. Rep. of Germany | 206/145 |
| 2098585 | 3/1972 | France | 206/199 |
| 2547796 | 12/1984 | France | 206/145 |

*Primary Examiner*—Jimmy G. Foster
*Attorney, Agent, or Firm*—Wenderoth, Lind & Ponack

[57] ABSTRACT

A device for supporting and transporting a group of receptacles has a lower panel for retaining the receptacles and an upper panel connected to the lower panel for covering the receptacles held in openings of the lower panel. The openings of the lower panel are preferably circular and defined by alternating lines of weakness and cut lines, with a plurality of flanges extending from the lines of weakness for supporting the receptacles in the openings. A side panel can be provided for bar-code information. A handle is also provided.

47 Claims, 13 Drawing Sheets

DEVICES FOR THE SUPPORT AND GROUP TRANSPORT OF RECEPTACLES AND CARDBOARD LAMINATES FOR FORMING THE DEVICES

BACKGROUND OF THE INVENTION (1) Field of the Invention

This invention refers to devices for the support and group transport of receptacles, as well as the cardboard or pasteboard sheets for forming and reinforcing the devices.

The invention is intended to overcome the drawbacks or inconveniences that hitherto known devices have for the transport in groups of receptacles, especially receptacles of a cylindrical or slightly truncated-cone shaped opening, provided with a flange or shoulder, a specific example of application being currently known soft drink jars or cans.

(2) State of the Prior Art

In accordance with the state of the art, these types of support device are formed of bands or layers, in cardboard or plastic, in which openings are provided with flanges or radial projections for retention and into which are introduced the receptacles to be supported, which remain with their upper base or mouth exposed to the outside. Another well known form is that comprised of a plurality of flexible plastic rings which surround the opening of the receptacles, making several ways of grouping possible. Such devices thus incorporate two main deficiencies or inconveniences. One is of a hygienic nature, since the spilling or direct ingestion of the contents of the receptacles becomes more frequent every day, and it is not desirable that the dirt resulting from their being exposed during storage and transport accumulate in the mouths or caps of the receptacles. Another drawback is of an economic or commercial nature, in particular in relation to the use, more extensive every day, of a loading and control system called the bar code, reading of which is impossible with the supports presently known, especially if the receptacles are arranged in adjacent rows, unless it is done separately and with great difficulty in handling for each one of the receptacles, but never for the whole supported lot.

Another shortcoming of the known devices lies in the general lack of rigidity for a comfortable and uniform handling and transport of the lot of receptacles supported, unless they are very light. For example, they are not adequate for the typical jars or cans of soft drinks, in which a group of three units already attains a weight of about one kilogram. This limitation has been solved, for example, by means of basket devices, which involve an increased cost of the device and difficulties in its mechanical filling and reinforcing, or else by means of the presence of additional areas of adhesive which give cohesion to the whole, which means the presence of a more or less persistent or undesirable substance in the receptacle, in particular in the area of the opening. Also use of materials of greater rigidity has been resorted to, specifically plastics, giving rise to devices in which the receptacles are difficult to extract and, above all, generate ecologically unacceptable residues.

An additional drawback lies in the difficulty or impossibility of the known devices being provided with handles for transport without thereby substantially complicating their structure or the amount of material utilized.

SUMMARY OF THE INVENTION

Therefore, it is one objective of this invention to provide a device for the support and grouped transport of receptacles which covers the upper part of such receptacles; which has sufficient rigidity to support a variable number of such receptacles, even through they relatively heavy; which makes it possible to read a bar code for a number of receptacles; which is executed in an ecologically acceptable material; from which the receptacles are easy to extract; and that, without affecting the previous purposes, has a simple execution or reinforcement, including being provided with a handle, which allows its reinforcement and the incorporation of the receptacles by mechanical means.

The device of the invention fulfills the above objectives and others which will be stated later, when executed in cardboards or pasteboard and when it includes a smooth surface which covers the mouth of the receptacles, which protects the openings thereof from dirt, allows the printing and subsequent reading of a bar code for the whole set, provides sufficient rigidity to the support formed, increased in some forms of execution. All of this begins with a diecast sheet which is introduced over the mouth of the receptacles and which, by simple bending or adhesion, forms the support and transport device for the receptacles.

Other objectives and results of the invention are to provide a grouped support and transport device for receptacles in which, without altering its essential structure, a handle or means of holding are provided, as well as means to avoid possible oscillation or rocking of the receptacles supported, so that noises from their bumping are reduced, greater comfort is provided in handling and stacking the devices, and the risk of accidental detachment of any receptacle supported by the device is reduced.

In a basic embodiment, the device for grouped support and transport of receptacles of the invention is constructed of cardboard or pasteboard, and includes two surfaces. A lower surface is for retention of receptacles, and has fixed therein by opposite alternation between two lines of weakness and two lines of cut, a series of two or more openings for the retention of the receptacles. The openings are axially aligned. An upper surface covers the mouths of the receptacles, and is smooth and of rectangular shape. The contour of the retention openings is circular, with a diameter coinciding with or slightly greater than the mouth of the receptacles t be supported. Retention flanges for retention of the receptacles project from each of the lines of weakness in the shape of circular segments of concavely curved flanges.

Also in a preferable form of execution, the series of two or more aligned retention openings for receptacles is in tangential contact.

In optional embodiment, the device has lines for tearing or extraction transverse to the alignment of the receptacles, which allows dividing the device into portions which support or transport the number of receptacles desired by the consumer.

In another embodiment, especially for the support and transport of receptacles in two parallel rows and having a handle, a device according to the invention is made in cardboard or pasteboard and includes two lower surfaces for retention of receptacles arranged in an adjacent manner. Each surface has been defined, by opposite alternation between two lines of weakness and two lines of cut, a series of two or more openings for retention of receptacles. The openings are axially aligned. An upper surface covers the mouth of the receptacles, is smooth and of rectangular form, and from which a handle part extends. The contour of the openings is circular, with a diameter coinciding with or slightly greater than the mouth of the receptacles to be supported. Retention flanges project from each of the lines of weakness for retention of the receptacles, and are in the form of circular segments of concavely arched flanges.

In a preferable manner of execution, the area of union or transition between the lines of weakness and the lines of cut of the openings for retention of the receptacles has an empty space, or an approximately semi-circular open cut toward the inside of the openings.

In a preferred embodiment, the retention openings for the receptacles in each row are in tangential contact.

Likewise, and in a preferable form of execution, the weakness lines include lines of cut or a passing split, spaced and following the same arched contour.

In another embodiment, especially intended for support and transport of the receptacles in two parallel rows and with handle arrangements, a device according to the invention is executed in cardboard or pasteboard and includes an interior surface or face for retention of the receptacles in which two rows of two or more equal openings for retention of the receptacles have been defined. Each row is axially aligned and separated from one another by a smooth zone provided with a means of lifting. Each one of the receptacle retention openings has a form approximately equivalent to three quarters of a circle, of a diameter equal to or slightly larger than the mouth of the receptacles to be supported and transported. Some first flanges for retention of the receptacles project radially from the inside circular margin of the retention openings, are variable in number, and are situated in a position diametrically opposite the smooth area which separates the rows of retention openings. Some second unitary flanges for retention of the receptacles are at each side of the first flanges and extend to join with the smooth area. The second flanges adopt a form approximately of circular segments of concave flanges. Some U-shaped cuts are provided in the separation between the first and second retention flanges, and an upper surface or face covers the openings of the receptacles. The upper surface is smooth and substantially rectangular and has in its central area handle arrangements coinciding in position and dimension with those of the smooth area of the lower surface.

In another embodiment, especially intended for the support and transport of receptacles in two parallel lines, and with means of lifting (handles) and means of preventing the receptacles from rocking, a device according to the invention is executed in cardboard or pasteboard and includes a lower surface or face for the retention of receptacles in which, by diecasting and marking, two rows of two or more equal openings for the retention of the receptacles have been defined. Each row is axially aligned with its retention openings in tangential contact with the openings in the other row. Some handle arrangements occupy the space between the retention openings of the two rows. Each one of the retention openings has a circular form, of a diameter equal or slightly larger than the mouth of the receptacles to be supported and transported. Some first flanges for the retention of receptacles project radially toward the inside of the retention openings. These are variable in number, and are situated in a position diametrically opposite the other substantially equal flanges. Some second unitary flanges for retention of the receptacles are situated between the first flanges adopt the approximate form of circular segments of concave flanges, and are provided with U-shaped cuts in the separations between the first and the second retention flanges. The retention openings are occluded by some flaps which extend from the retention flanges situated in position adjacent to the other row of retention openings, toward the inside of retention openings. The flaps adhere at the inside of the device to an upper surface or face for covering the mouths of the receptacles, which surface is smooth and substantially rectangular, and which has in its central area handle arrangements coinciding in position and dimension with those of the lower surface or face for the retention of the receptacles.

In a preferred embodiment, the retention openings of each row are in tangential contact.

In a preferred embodiment, the tangential contact zone between the retention openings has a cut or a passing split which facilitates the lifting of the retention flange in that zone.

In a preferred form of the invention, the handle arrangements are comprised of two or more aligned openings, of a diameter greater than that of the finger of an adult.

In any of the foregoing executions, the device of the invention is manufactured from a cardboard or pasteboard sheet, also according to the invention, in which the surfaces or retaining and covering faces show the characteristics and configurations previously defined and which are joined by means of the corresponding flaps or parts which, by folding or bending and subsequent gluing or stapling, permit formation of the device of the invention.

BRIEF DESCRIPTION OF THE DRAWINGS

A better understanding of the improvements offered by the invention is obtained from the detailed description of the forms of practical execution which follows, illustrated in the attached pages of drawings, in which.

DETAILED DESCRIPTION OF THE PREFERRED EMBODIMENTS

Figure 1:
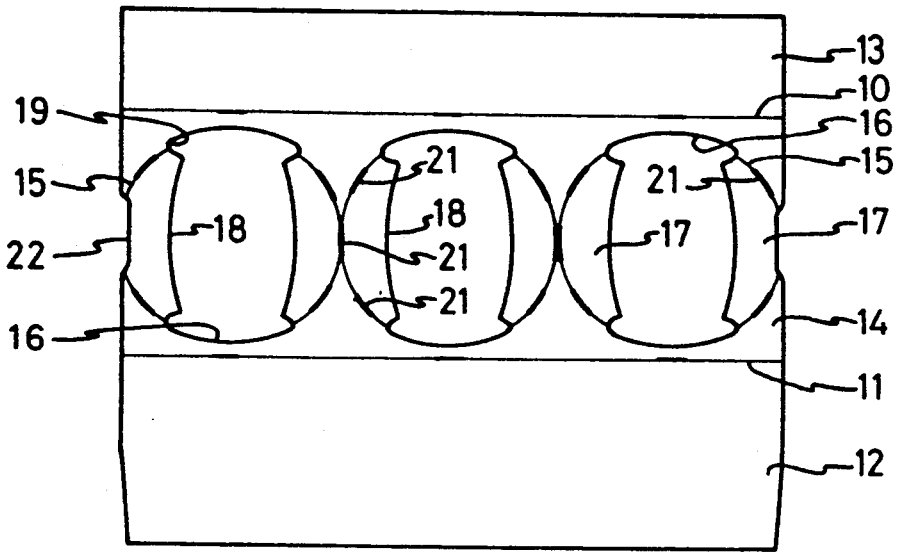
FIG. 1 is a diagram of an example of a cardboard sheet forming a device according to the invention according to a first embodiment.
Figure 3:
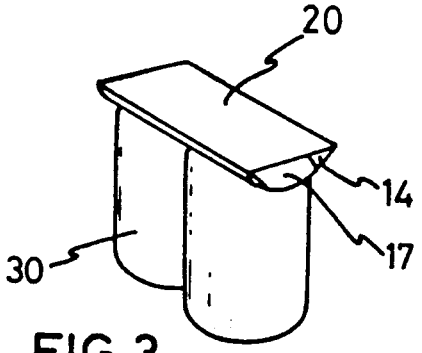
FIGS. 3 and 4 are views in perspective of one example of the device of the invention already and applied on two and three receptacles, respectively.
Figure 4:
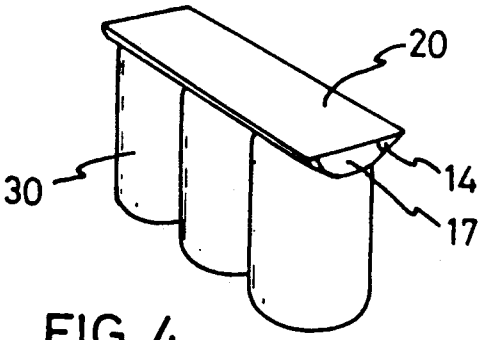

In FIG. 1 an example is illustrated of the diecast sheet of cardboard or pasteboard for executing a support and transport device for receptacles according to the invention. The sheet adopts a combination of a base that is approximately rectangular, in which by lines marked or folded (10, 11) two surfaces or flaps (12, 13) have been determined. The end flaps are rectangular and of different width (although they could be equal) and by superposition, as illustrated in FIG. 2, being joined by means of adhesive or other means, determine the shaping of an upper surface (20) of the support device for receptacles according to the invention, as illustrated in FIGS. 3 and 4.

The central surface (14) of the sheet shows a series of openings for retention of identical receptacles (three in the example), axially aligned, of circular contour and in tangential contact, each one determined by the regular or diametrically opposed alternation between lines of weakness (15) and lines of cut (16), which together compose the cited circular contour. From the lines of weakness (15) project retention flanges (17) for each receptacle, approximately in the form of a circular flange segment, arched concavely.

Preferably, each one of the points of zones of transition or separation between lines of weakness (15) and lines of cut (16) have a small space or cut, approximately semi-circular (19), the purpose of which will be explained later.

Figure 2:
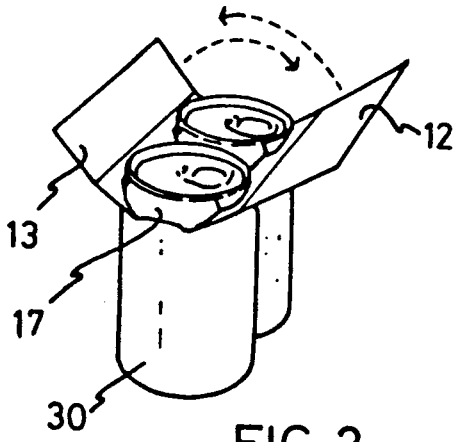
FIG. 2 is a perspective view illustrating the application of a sheet similar to the one of the previous figure on two receptacles.

As illustrated in FIG. 2, the sheet is superimposed on the receptacles (30) through their area (14) provided with openings for retention of receptacles (30).

The receptacles (30) may be of a larger variety of types. Instead those may be preferred which, due to having the form of a frustum with a shoulder in their mouth area, determine with a flange a perimetral split or slot. An example are the cans illustrated in FIG. 2, although it could also be true with other receptacles, including those in which their cap determines the formation of the said perimetral split or slot in the proximity of their mouth.

The diameter of the mouth of the receptacles (30) should coincide with or be slightly less than the contour of the retention openings of the area (14) of the sheet, which when it is superimposed is pressured toward the base of the receptacles until the edge (18) of the flanges (17) pops into the perimetral split or slot of the mouth of the receptacles (30). Then the flaps (12, 13) are folded and joined, as indicated previously, and the support device of the invention is shaped with its upper surfaces smooth (20) and the lower retention area (14) as represented in FIGS. 3 and 4.

Figure 5:
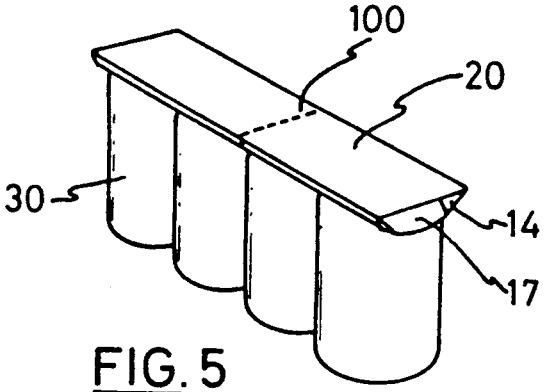
FIG. 5 is a view in perspective of one example of the device of the invention already shaped and applied on four receptacles, with the possibility of dividing the device into groups of two receptacles.

In these figures, and as an understandable result, the possibility is also illustrated that a device according to the invention might support groups of two or more receptacles (30), as a function of the number of openings for retention of receptacles with which it is equipped. Thus, in FIG. 5 a device supporting four receptacles (30) is illustrated which could also be divided into groups of two receptacles, by dividing along lines (100) by tearing or pulling off, the lines (100) being previously marked in a direction transverse to the alignment of the receptacles (30) and passing between the retention openings.

By the preceding description, it is deduced that the joining between the support device and receptacles (30) depends on the flexion or ease of folding of the flanges (17) along the lines of weakening (15). Furthermore, it is included and can be observed in FIGS. 3, 4 and 5, that the lower surface (14) of the device suffers a concave-convex deformation as soon as the flanges (17) come out in the perimetral split of the receptacles (30), which ease of deformation is also a function of the articulation of the flanges (17) along the lines (15).

In order to increase the folding or flexion of the flanges (17), in the example illustrated in FIG. 1, the lines of weakness (15) are shown spaced and in a coinciding arched contour with some cuts or passing splits (21), for example at the positions illustrated in the example. These cuts, along the margins of the surface (14) of the sheet, are replaced by small notches (22).

Figure 6:
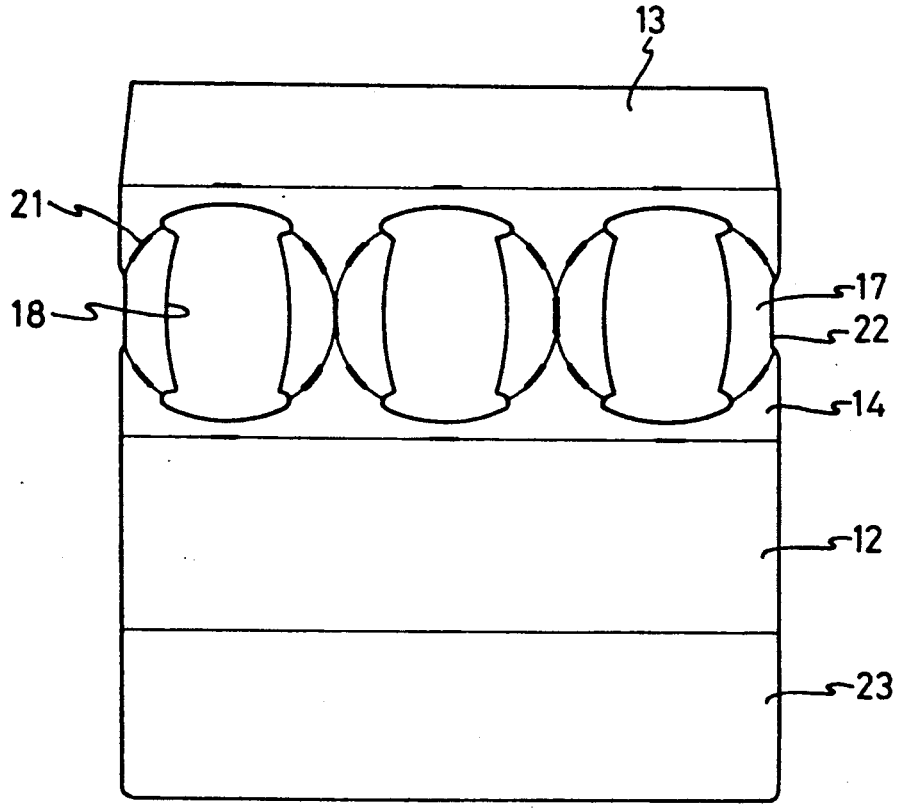
FIG. 6 is a diagram of one example of a sheet of cardboard capable of shaping a device according to a further embodiment of the invention.

In FIG. 6 and the figures following, other examples of ways of execution of the device of the invention are represented, as well as examples of diecast sheets for shaping such devices. In these figures the same numerical references as used above are employed to designate similar parts or pieces, and in the description that follows specific mention will only be made of the variations introduced with respect to what is described and illustrated with reference to FIGS. 1 and 5.

Figure 7:
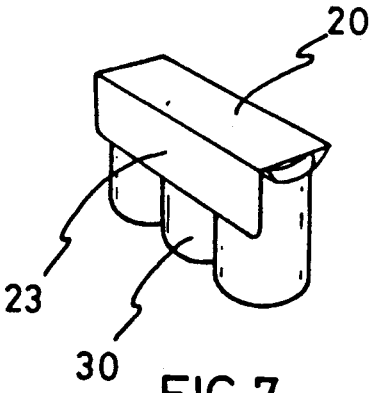
FIG. 7 is a view of perspective illustrating a device according to the invention shaped from the sheet of the previous figure.

Thus, in FIG. 6 a similar sheet to that of FIG. 1 is represented, except that it includes a flap (23) in continuation of the flap (12), the purpose of which, as can be seen in FIG. 7, is to provide an additional surface or panel in contact with the side of the receptacles (30) capable of containing information on the content of the receptacles, and also to add transverse rigidity to the device. It is understood that the dimensions of the surface or panel which the flap (23) provides may vary from case to case, as well as the possible presence of adhesive between the inside face of the panel and the lateral surfaces of the receptacles (30), providing a greater security of retention by the support device. Likewise, this device can be provided with tearing or extraction lines (100) mentioned in relation to FIG. 5.

Figure 9:
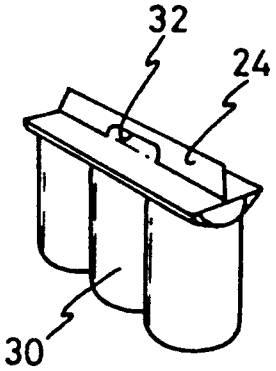
FIG. 9 is a view in perspective of a device according to the invention shaped from the sheet in the previous figure.
Figure 8:
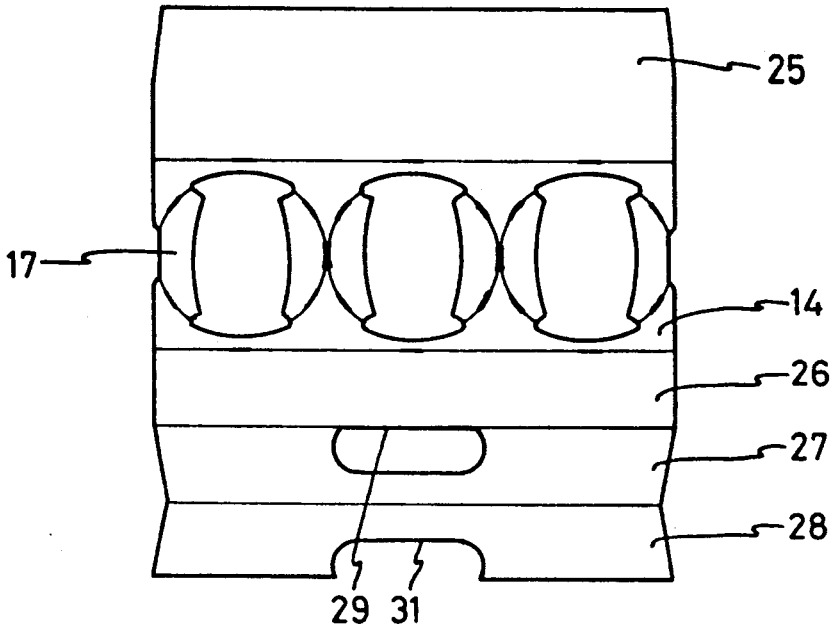
FIG. 8 is a diagram of an example of a cardboard sheet capable of shaping a device according to a third embodiment of the invention, equipped with a handle.

In FIG. 8 an example of a diecast is represented, which permits a support and transport device like the one illustrated in FIG. 9, which is differentiated from the previous devices in being provided with an upper handle (24). As represented in FIG. 8, the surface (14) provided with openings for retention of receptacles is extended on one end by means of a rectangular flap (25) and on the other end by means of a first rectangular flap (26) of a width approximately equal to half of that corresponding to the surface (14) and two equal flaps (27, 28), one provided with an opening (29) and the other with a notch (31) with which it partially coincides in shape.

In order to form the support device according to the invention illustrated in FIG. 9, from the diecast sheet of FIG. 8, the flap (25) is folded onto the surface (14), of course after the introduction of the mouth or cap of the receptacles (30), and then onto the flap (25) is folded the flap (26) with the interposition of an adhesive, so that the device is basically formed. Finally the handle (24) is formed by joining the flaps (27, 28), opening (29) and notch (31) coinciding to form a window (32) for introduction of a user's fingers. It is understood that the width of the flaps (27, 28) depends on the height desired for the handle (24), and also, as represented in the example, the flaps (27, 28) can have a slightly trapezoidal shape.

Figure 11:
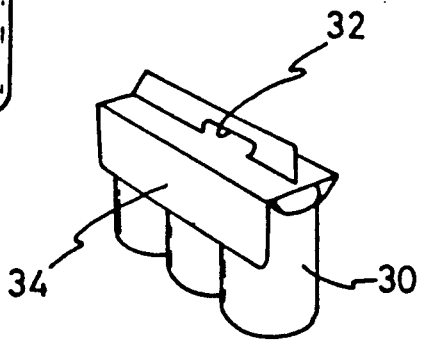
FIG. 11 is a view in perspective of a device according to the invention shaped from the sheet in the previous figure.
Figure 10:
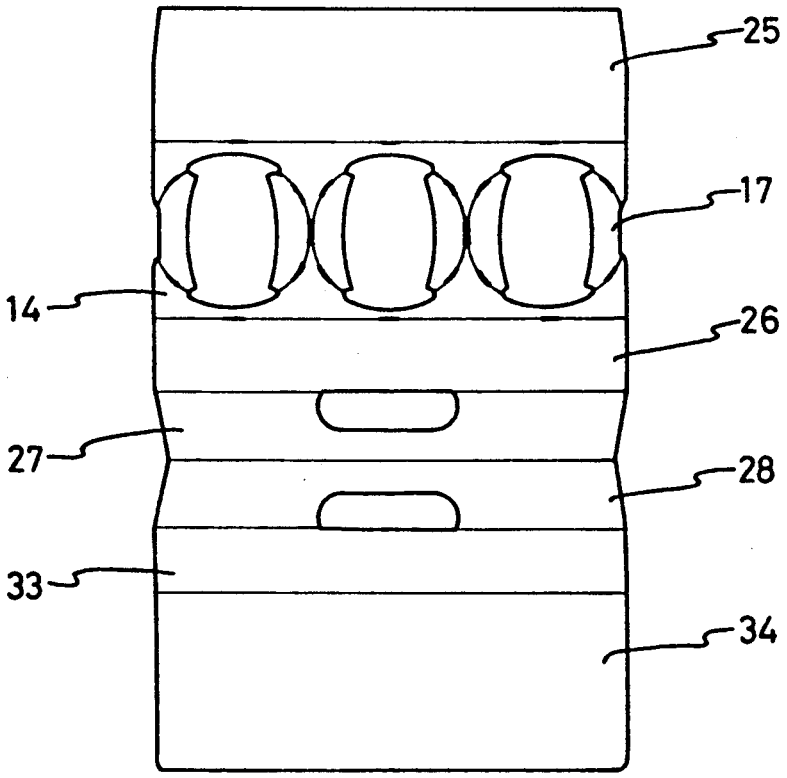
FIG. 10 is a diagram of an example of a sheet of cardboard capable of shaping a device according to a fourth embodiment of the invention, also provided with a handle.

In FIG. 10 an example of a sheet similar to the one in FIG. 8 is represented, except that it is extended at one of its ends into a front flap (33) of equal dimensions to flap (26), and into a second flap (34) of variable dimensions. The result is the device illustrated in FIG. 11, provided with a panel which performs the same functions enunciated in the description of the sheet and device of FIGS. 6 and 7.

As mentioned before, the support device according to the invention may support two or more receptacles (30). However, according to the weight of the receptacles (30), after three or four units the upper and lower surfaces (20, 14) of the device may experience some deformation during handling by the user.

For such cases of heavy receptacles, or for a relatively high number of receptacles to be supported, it will be preferable to utilize a device according to the invention, examples of which, and sheets capable of forming the examples are illustrated in FIGS. 12 to 22.

Figure 12:
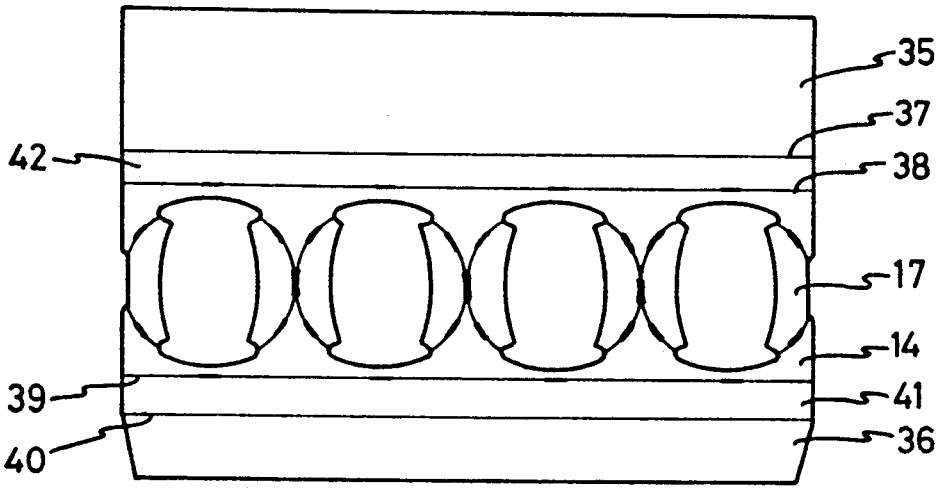
FIG. 12 is a diagram of a cardboard sheet capable of being shaped into a device according to a fifth embodiment of the invention.
Figure 16:
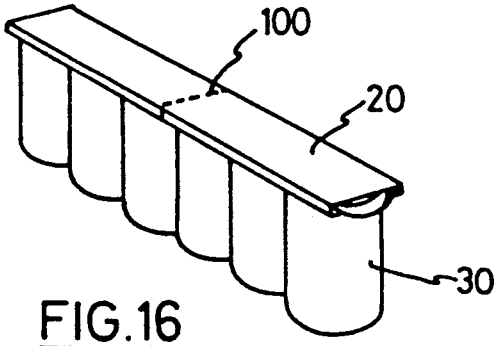
FIG. 16 is a view in perspective of an example of a device according to the invention already shaped and applied on six receptacles, with the possibility of dividing them into groups of three receptacles.

In FIG. 12, a sheet which substantially coincides with the example of basic execution illustrated in FIG. 1 is represented. The difference lies in the fact that each side of the central surface (14), which is equipped with openings for retention of receptacles, before the end flaps (35, 36) by means of spaced parts of folding lines (37, 38) and (39, 40) has two narrow rigidizing flaps (41, 42) which, when folded to form a device according to FIGS. 13 to 16, comprise edges, by the lines (37, 38, 39, 40), which work as rigidizing strength or resistance to the forces which the device experiences when being picked up. As represented in FIG. 16, this execution of the device may also be equipped with tearing or extraction lines (100).

Figure 17:
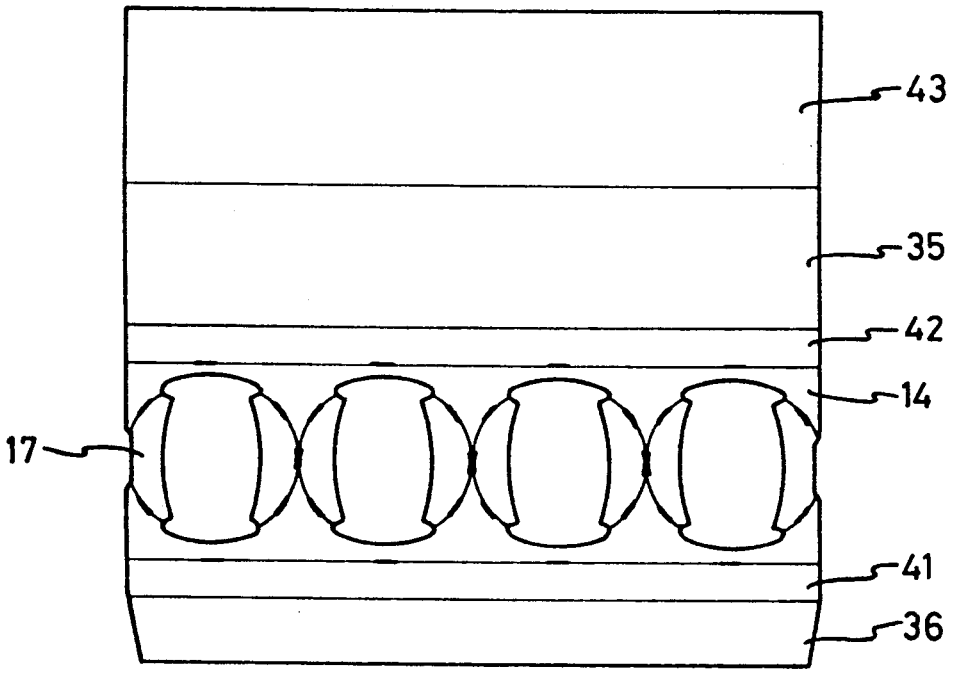
FIG. 17 is a diagram of an example of a cardboard sheet capable of being shaped into a device according to a sixth embodiment of the invention.
Figure 13:
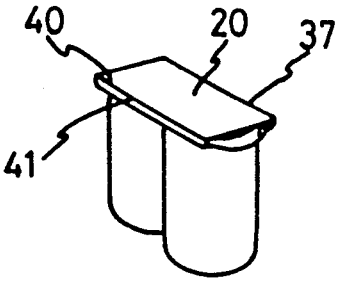
FIGS. 13, 14 and 15 are views in perspective illustrating an example of a device according to the invention shaped from sheets similar to those of the preceding figure, applied on two, three and four receptacles, respectively.
Figure 14:
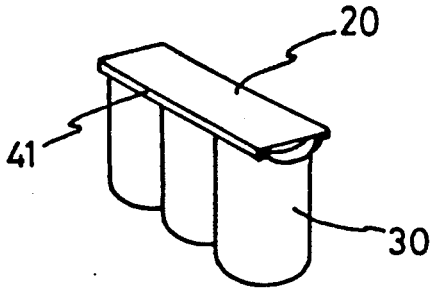
Figure 15:
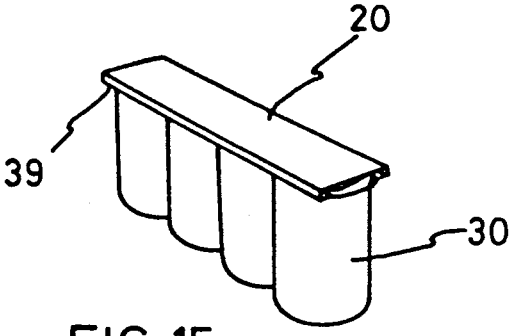
Figure 18:
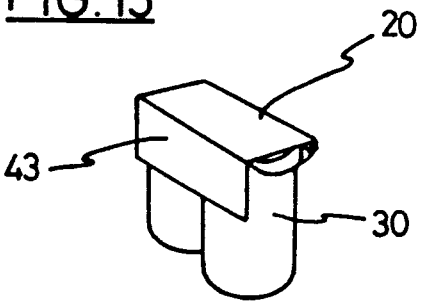
FIG. 18 is a view in perspective of a device according to the invention shaped from a sheet similar to that of the previous figure.

In FIG. 17, an example of a sheet similar to the one in FIG. 12 is represented, except that it includes a flap (43) in continuation of the flap (35), comprising a panel for the device illustrated in FIG. 18, the function of which has previously been explained.

Figure 20:
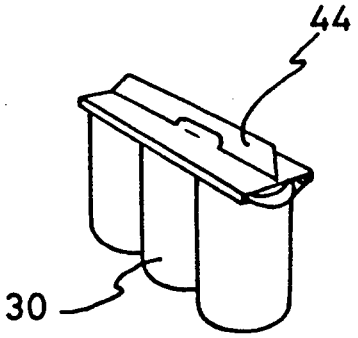
FIG. 20 is a view in perspective of a device according to the invention shaped from a sheet similar to that of the previous figure.
Figure 19:
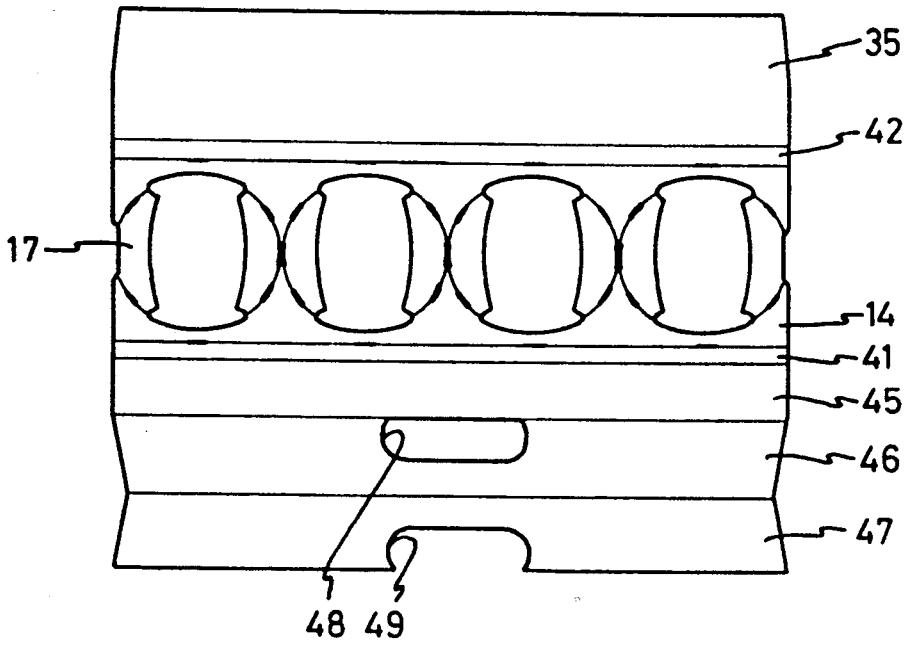
FIG. 19 is a diagram of an example of a sheet of cardboard capable of being shaped into a device according to a seventh embodiment of the invention, provided with a handle.

In FIG. 19 an example of the diecast sheet from which is derived the device illustrated in FIG. 20 is represented, which is differentiated from the previous figures by an upper handle (44). As it is represented in FIG. 19, one of the narrow rigidizing flaps (41, 42), in the example flap (41), is joined to or is extended by means of, a first rectangular flap (45) of a width approximately equal to half that corresponding to the surface (14) provided with openings for retention of receptacles. Two flaps (46, 47) of equal width, one provided with an opening (48) and the other with a notch (49) partially coinciding in shape with the opening (48), are connected to flap (45). The way of folding and retention is the same as explained for the example in FIG. 8, and the results are the device which is illustrated in FIG. 20.

Figure 22:
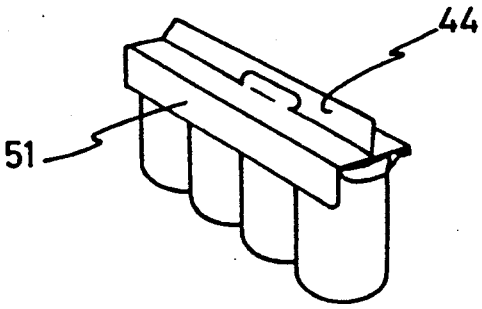
FIG. 22 is a view in perspective of a device according to the invention shaped from a sheet similar to that of the previous figure.
Figure 21:
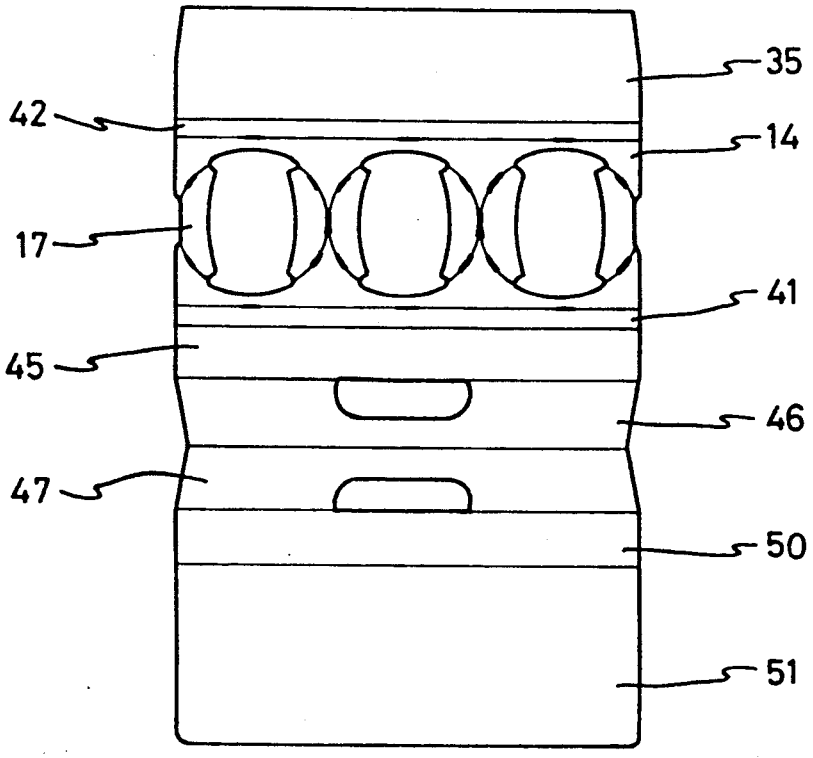
FIG. 21 is a diagram of an example of a sheet of cardboard capable of being shaped into a device according to an eighth embodiment of the invention, in another form of execution also provided with a handle.

In FIG. 21 an example of a sheet similar to the one in FIG. 19 is represented, except that it is extended at one of its ends into a first flap (50) of equal dimensions as flap (45), and a second flap (51) of variable dimensions. The result is the device illustrated in FIG. 22, provided with a panel which performs the same functions as enunciated in the description of the sheet and device in FIGS. 6, 7, 10, 11, 17 and 18.

Figure 23:
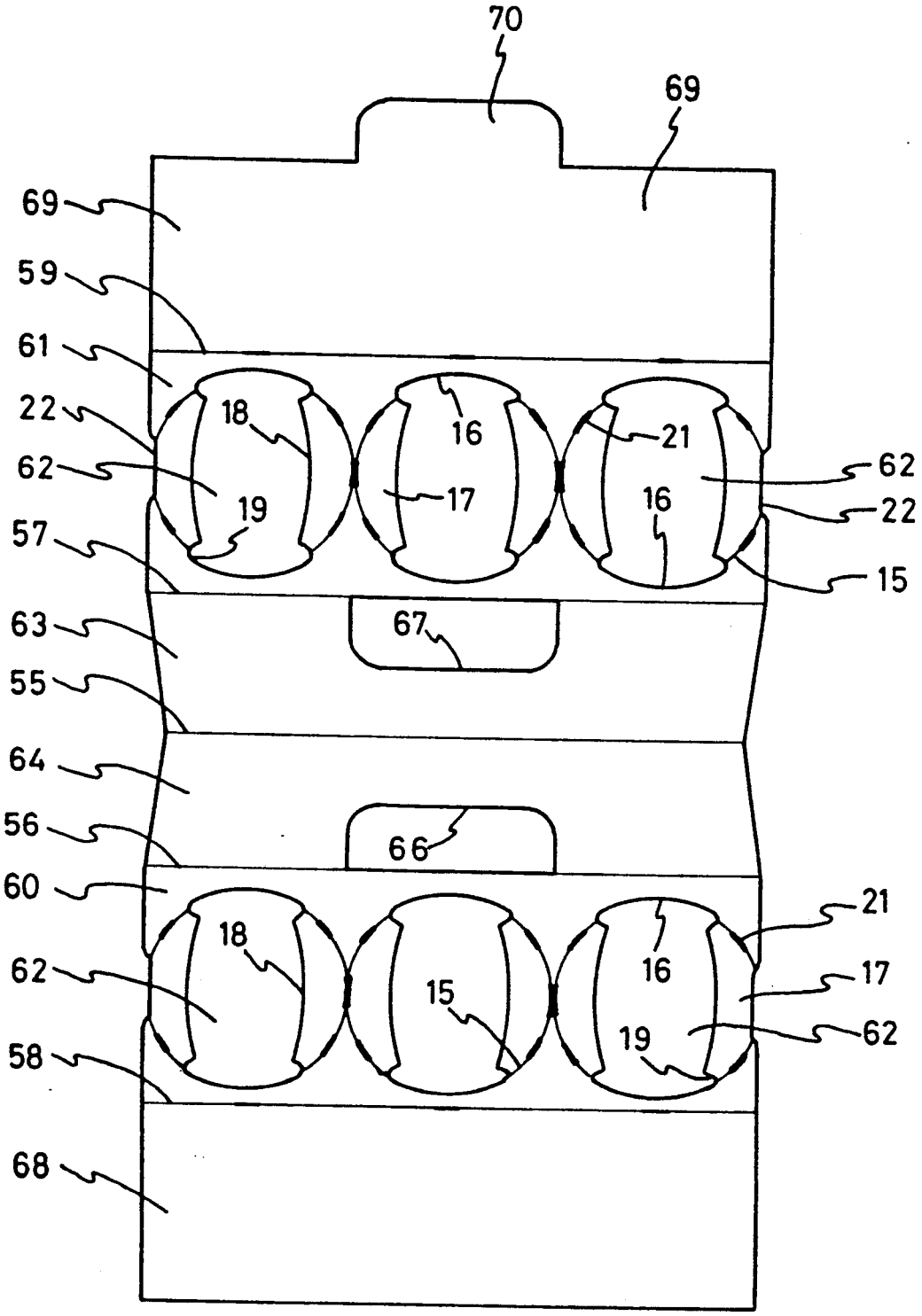
FIG. 23 is a diagram of an example of a cardboard sheet capable of being shaped into a device according to a ninth embodiment of the invention adapted for two rows of receptacles and provided with handle.
Figure 25:
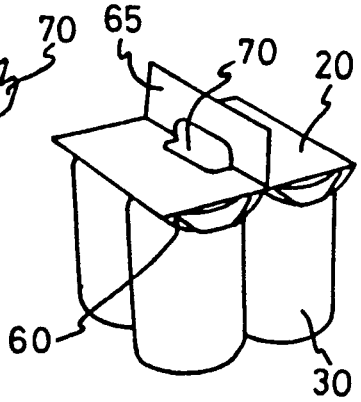
FIGS. 25 and 26 are views in perspective illustrating a device according to the invention applied on pairs of rows of two and three receptacles respectively.
Figure 26:
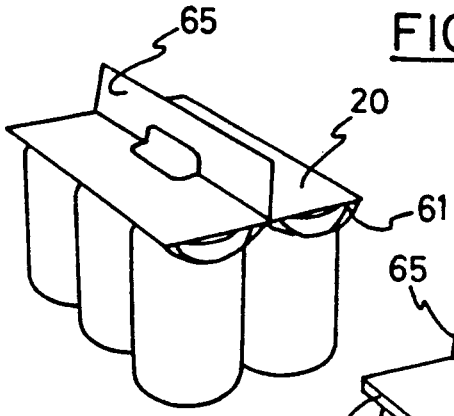

In FIG. 23 an example is illustrated of a diecast sheet, of cardboard or pasteboard, for forming a support and transport device for receptacles according to the invention, especially destined to support receptacles (30) in two parallel rows. As represented, the sheet adopts overall an approximately rectangular base, in which two surfaces or flaps have been determined by lines marked or folded (55, 56, 57, 58, 59) provided with openings (62) for retention of receptacles, between which two flaps are located (63, 64) for making a handle. By backing and superimposition, as illustrated in FIG. 24, and joining by means of adhesive or other means, the upper surface (20) and the handle (65) of the receptacle support device in two rows according to the invention are formed, as illustrated in FIGS. 25 and 26.

The surfaces or flaps (60, 61) of the sheet each have a series of openings (62) for retention of receptacles (three in the example) that are equal, axially aligned, of circular contour and in tangential contact. Each one is formed, as explained previously, by the regular or diametrically opposed alternation between lines of weakness (15) and lines of cut (16) which together compose the circular contour. From the lines of weakness (15) project retention flanges (17) for each receptacle, having a form approximating a circular flange segment (18), curved concavely. Also, according to what was previously mentioned, each one of the points or zones of union or transition between lines of weakness (15) and lines of cut (16) will have a small space or cut (19) that is approximately semi-circular, the function of which is to improve the adaptation of the retention openings (62) at the mouth of the receptacles, in particular at the edge of where they are provided.

The central flaps (63, 64) of the sheet have openings (66, 67) centered in form, position and dimension, coinciding, and intended to make together with the flaps (63, 64), the handle (65) of the device.

Figure 24:
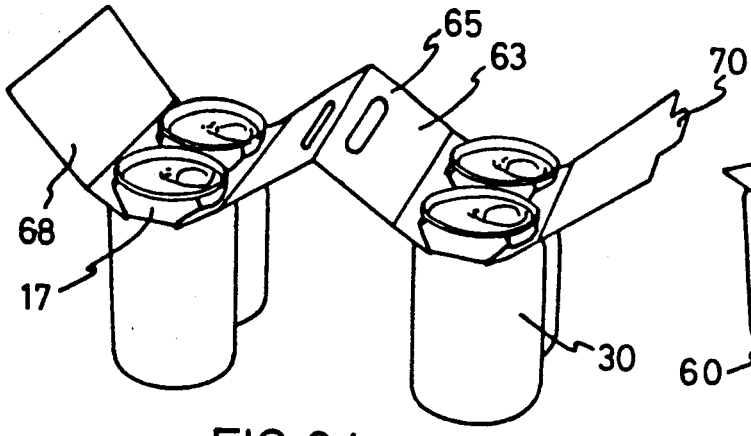
FIG. 24 is a view in perspective illustrating the application of a sheet similar to the one in the previous figure on two pairs of receptacles.

As illustrated in FIG. 24, the sheet is superimposed on parallel rows of receptacles (30) with their flaps (60, 61), provided with openings (62) for retention of receptacles. As in the previously described embodiments, the diameter of the mouths of the receptacles (30) coincides or is slightly less than the contour of the openings (62) of the flaps (60, 61) of the sheet, which when superimposed is pressed toward the base of the receptacles until the edge (18) of the flanges (17) it is popped into the perimetral split or slot of the mouth of the receptacles (30). Then the flaps (63, 64) are folded on the line (55) until they are back to back, along with two rows of receptacles (30) in the retention openings (62). Finally, flaps (68, 69) at the end of the sheet are folded onto the mouth of the receptacles (30). One of those flaps, in the example flap (69), has an appendix or projection (70) of a form, position and dimensions coincident with the openings (66, 67) of the flaps (63, 64). The flap (70) passes through, coming to be located in contact with the flap (68) and retained by an adhesive or other means of retention. Thus the support device is formed with an upper surface smooth (20), a perpendicular handle (65) and lower adjacent surfaces of retention (60, 61) as represented in FIGS. 25 and 26. This embodiment also can have two or more receptacles in each row.

Also, as in the previous embodiments, to increase the articulation or flexion of the flanges (17) in the openings (62), the lines of weakening (15) are spaced and in an arched contour. Some cuts and passing splits (21) for example in the positions illustrated in FIG. 23, are also provided. Such cuts (21) are replaced by small notches (22) in the margins of the flaps (60, 61) of the sheet.

Figure 29:
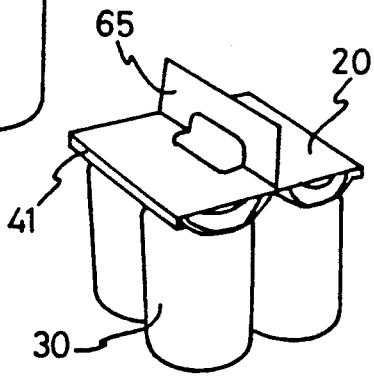

In this embodiment two rows of two or more receptacles (30) each can be provided. However, as was previously explained, for heavy receptacles or for a relatively high number of receptacles to be supported, the use of a device illustrated in FIGS. 27 and 29 is preferred.

Figure 28:
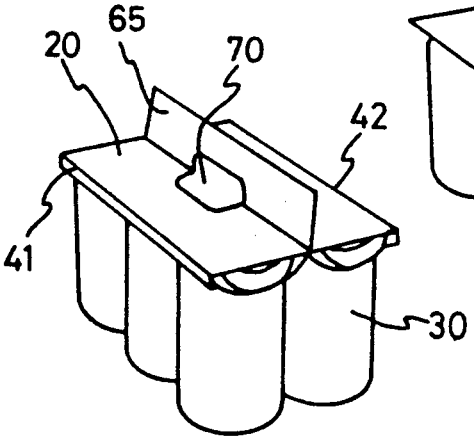
FIGS. 28 and 29 are views in perspective of a device according to the invention shaped from a sheet similar to that of the previous figure applied on pairs of two and three receptacles, respectively.
Figure 27:
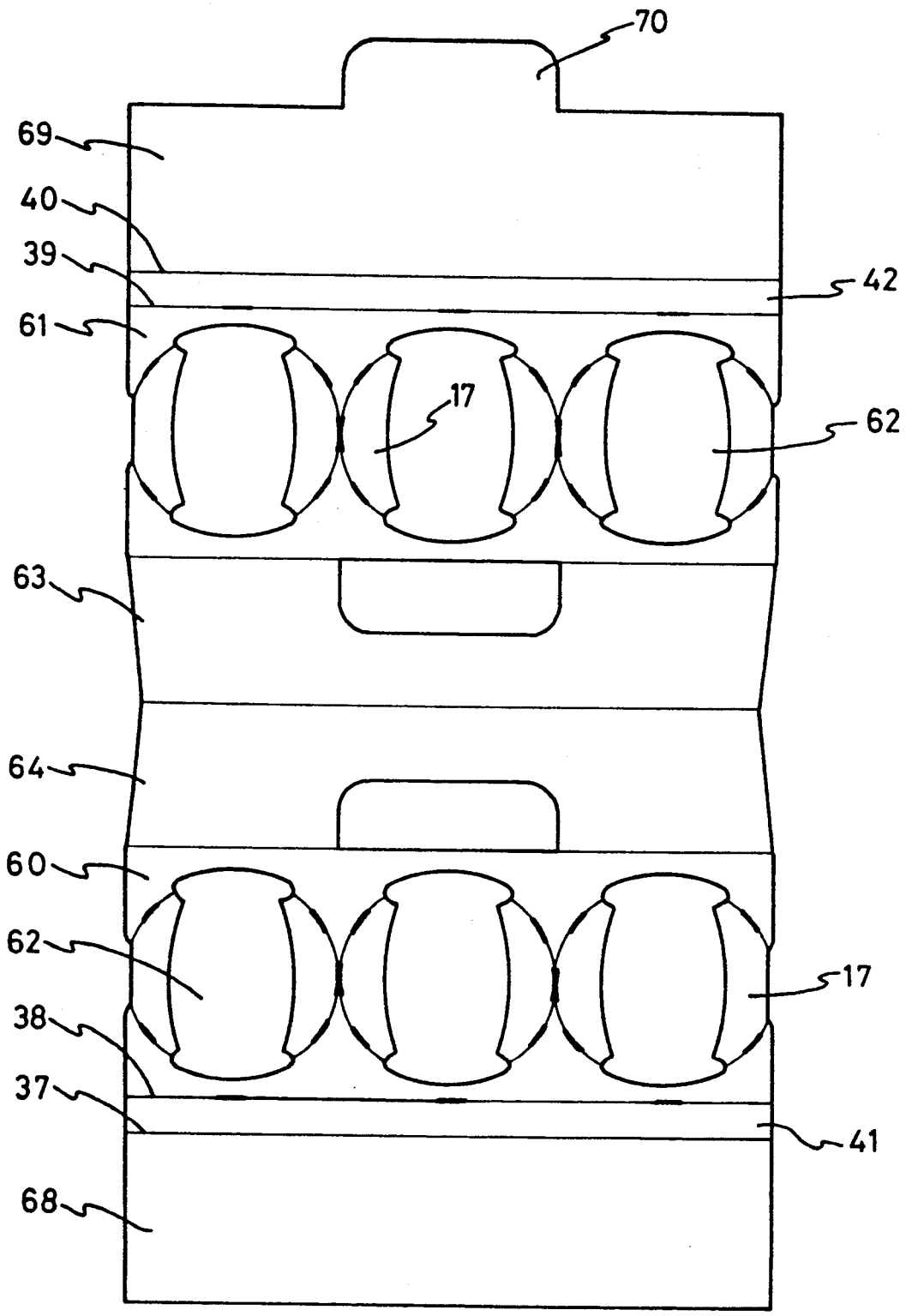
FIG. 27 is a diagram of an example of a cardboard sheet capable of being shaped into a device according to a tenth embodiment of the invention.

In FIG. 27 an example of a sheet is presented which coincide substantially with the example illustrated in FIG. 23. The difference lies in the fact that between the flaps (60) and (68) and (61) and (69), formed by spaced pairs of folding lines (37, 38) and (39, 40), are two narrow rigidizing flaps (41, 42). The device according to FIGS. 28 and 29 is formed by folding, and comprises edges due to lines (37, 38, 39, 40) which work as rigidizing or strengthening flaps resistant to the forces which the device experiences on being picked up.

By the preceding description, it is deduced that one of the principal characteristics of the device of the invention lies in the configuration of the openings for the retention of the receptacles, on the basis of the pair of retention flanges (17) disposed opposite each other.

Figure 30:
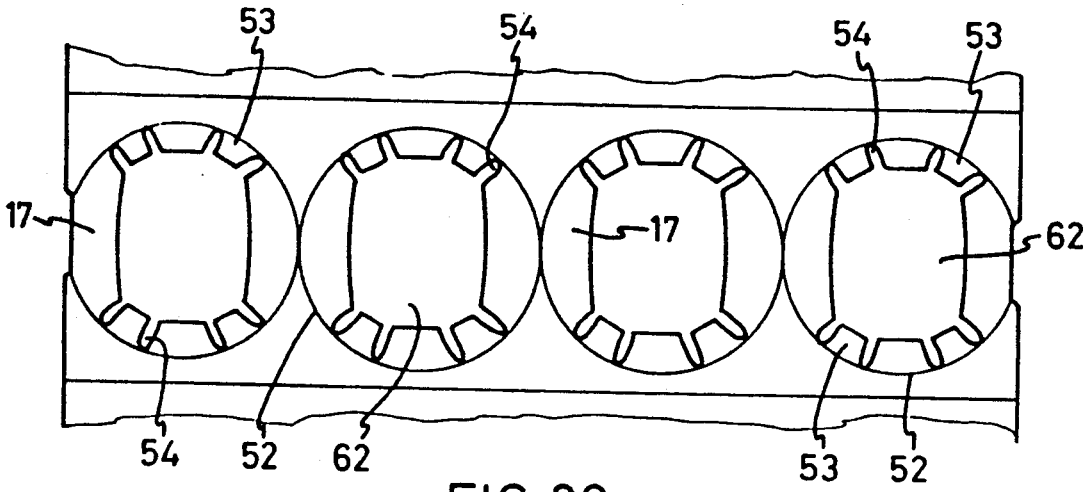
FIG. 30 is a diagram illustrating an example of a different way of executing the openings equipped with retention flanges for the receptacles, applicable to any of the previous embodiments.

Despite obtaining satisfactory results with such flanges, in FIG. 30 an alternative embodiment is presented for the retention openings, applicable to all the examples described previously. In this form, the retention openings are formed in a circular, marked line (52) of a diameter coinciding or slightly greater than the mouth of the receptacles (30), and from that marked line, besides the flanges (17) already described, other smaller flanges (53) project radially, separated by lines of cut (54), the rest of the opening being empty. The result will be a retention opening, with flanges (17) and (53), which will completely surround the mouth of the receptacle, and will be introduced by its edges into the split or slot for each mouth.

Figure 31:
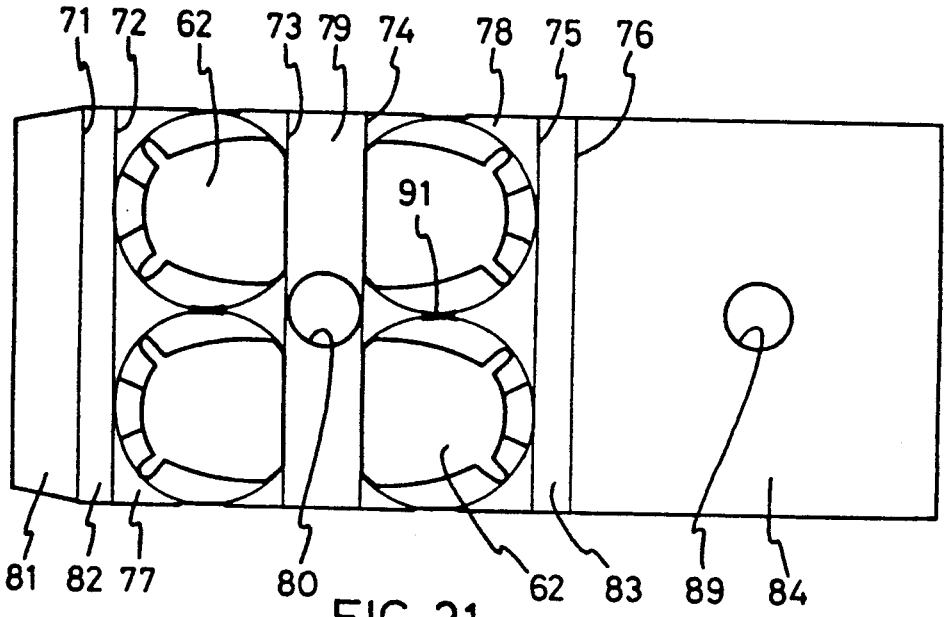
FIG. 31 is a diagram of an example of a cardboard sheet capable of being shaped into a device according to the invention for four receptacles in two rows.

In FIG. 31, an example of a cardboard or pasteboard sheet is illustrated, diecast and marked for forming a support device for receptacles in two rows in a more simplified form than the one described in the preceding paragraphs. In this case, the sheet has an approximately rectangular base. Lines of marking or folding (71, 72, 73, 74, 75, 76) form two surfaces or zones (77, 78). Rows of openings (62) for retention of receptacles are provided, between which is located a flap (79) provided with an opening (80), which will comprise part of a handling or fastening arrangement for the assembly. On each side of the surfaces (77, 78) extend flaps 81, 82) and (83, 84), the function of which is explained later. The surfaces (77, 78) comprise together the lower surface o face for retention of the receptacles of the device of the invention, and the flap (84) comprises the upper surface or face for protection of the receptacles, according to the characteristics of the invention previously enunciated.

In this form of execution, the openings (62) adopt generally a form approximately three quarters of a circle, interrupted by its contact with the marked lines (73, 74) which delimit the flap or central zone (79) which divides the surfaces (77, 78). The diameter of these retention openings (62) is understood to be equal or slightly greater than the one corresponding to the mouth of the receptacles to be supported.

From the inside circular margin of the retention openings are first retention flanges (85), three in the example represented, but which might be in any other number. The first retention flanges (85) are situated in a position diametrically opposite to the central dividing flap (79). Some second unitary retention flanges (86), two in each opening (62), are situated on each side of the first retention flanges (85) and adopt a form approximating a circular segment of concave flange, extended at their narrowest end to join or make contact with the central divider (79). The first retention flanges (85) are separated by straight radical cuts (87), while the separation between the group of first retention flanges (85) and second flanges (86) is determined by larger U-shaped cuts (88) intended to facilitate the deformation of the flanges (85, 86) at the moment of introduction of the mouth of the receptacles into the retention openings (62).

Figure 32:
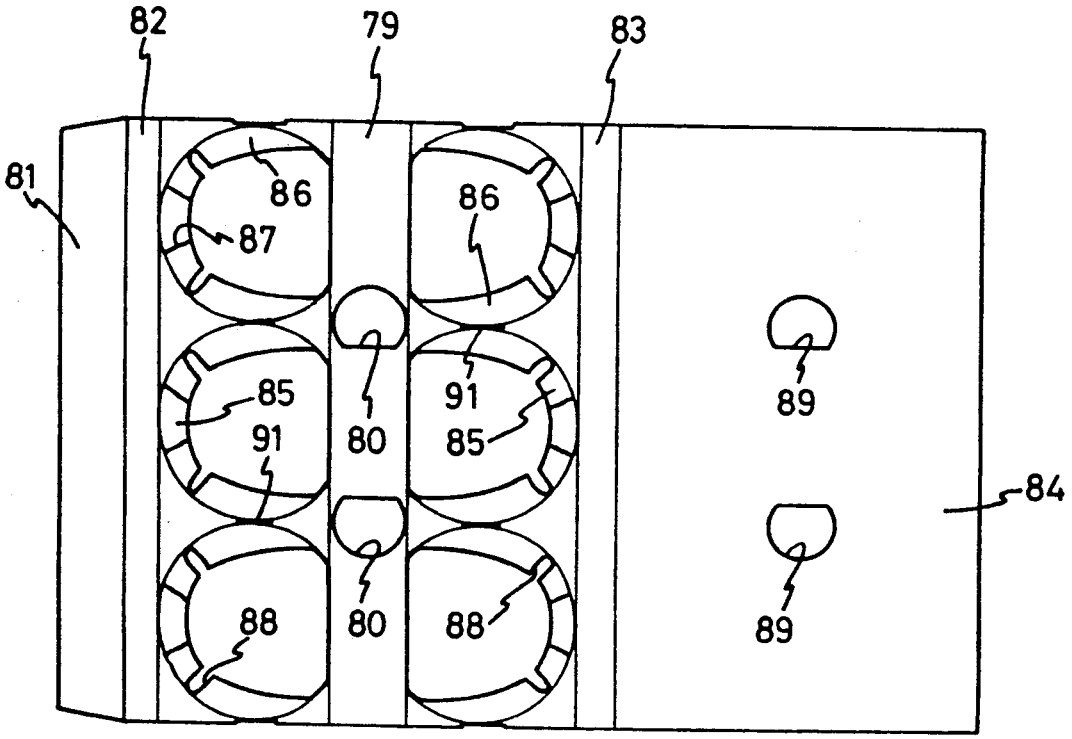
FIG. 32 is a view similar to FIG. 31, for six receptacles in two rows.
Figure 33:
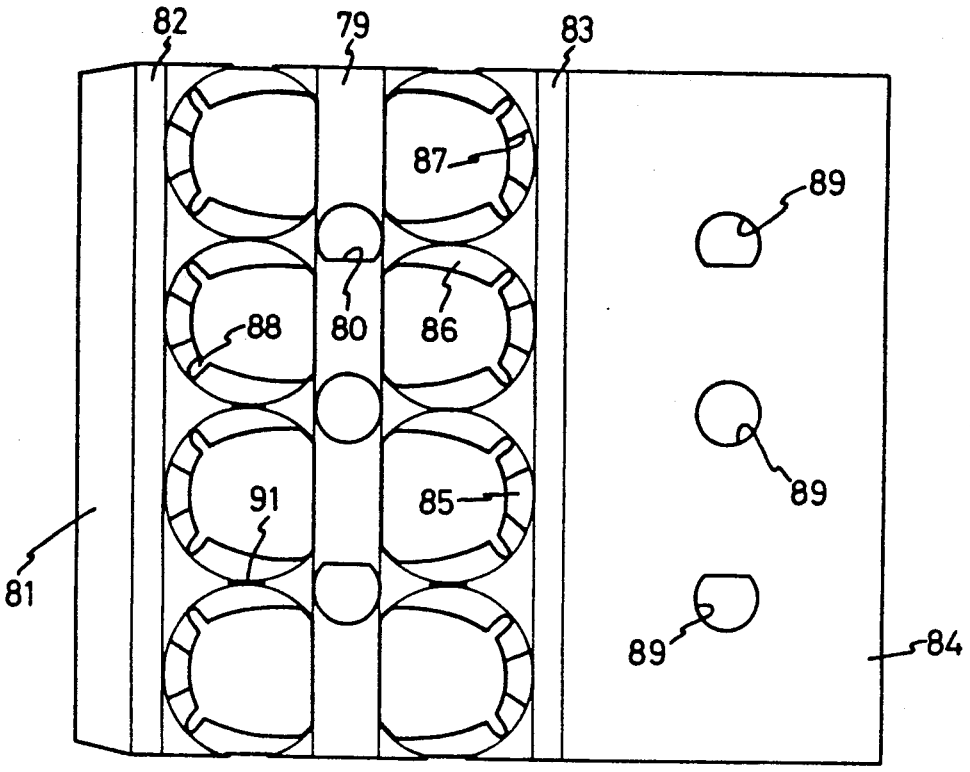
FIG. 33 is a view similar to FIGS. 31 and 32, for eight receptacles in two rows.

In FIGS. 32 and 33, sheets which are the same as the one represented in FIG. 31 are represented, except that they are respectively adapted for the support of six and eight receptacles in two rows of retention openings (62). In view of the consequent greater weight to be supported by the devices which the sheets would make, a larger number of handle arrangements has been provided. Thus, while in FIG. 31 the handle arrangements will be comprised by a coincidence of the opening (80) in the flap (79) with the opening (89) in the flap (84), when the flap (84) is folded down on the flap (79), in FIG. 32 the openings for the handles are double, and in FIG. 33 triple. In these figures the same numerical references have been used for designating the same parts or elements.

Figure 34:
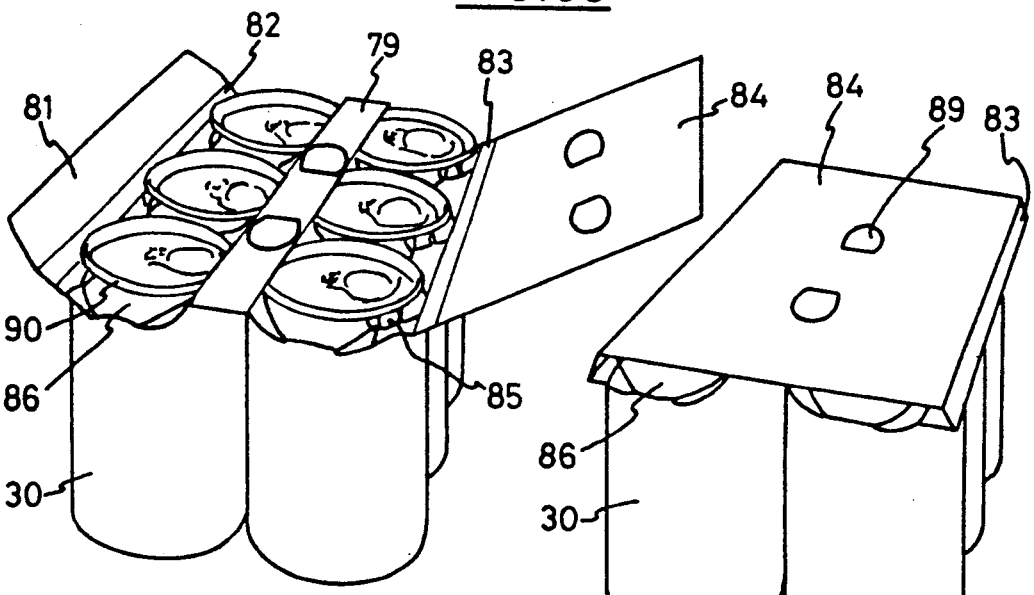
FIG. 34 is a view in perspective illustrating the application of the sheet represented in FIG. 32 on two rows of three receptacles.
Figure 35:
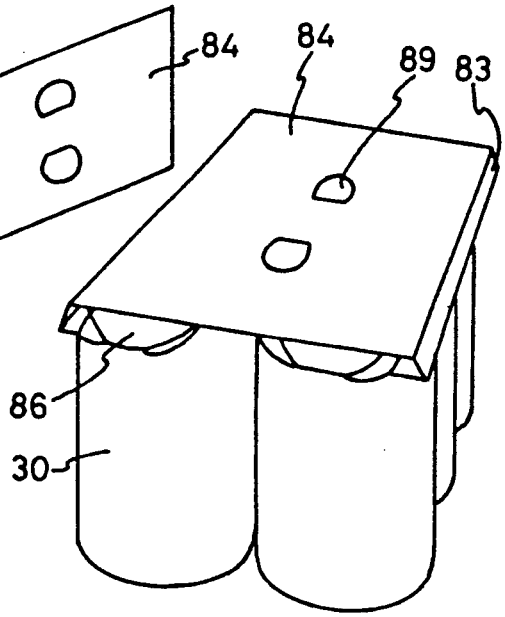
FIG. 35 is a view similar to FIG. 34 with the device of the invention already shaped.
Figure 36:
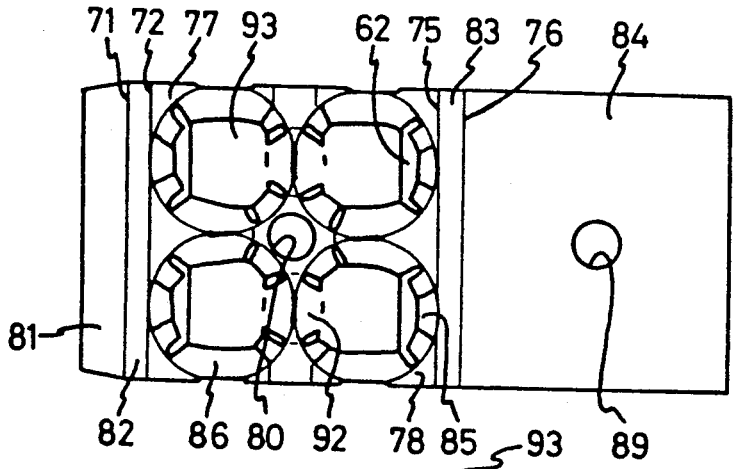
FIG. 36 is a diagram of an example of a cardboard sheet capable of shaping a device according to a further embodiment of the invention for four receptacles in two rows.

In FIG. 34 a phase of the reinforcement of the device of the invention is represented, with two rows of three receptacles (30). As is observed, the sheet is introduced over the properly grouped receptacles until the mouths of the latter penetrate into the retention openings and the retention flanges (85, 86) are popped into the lower part of the rim (90) which these receptacles have at their mouth. The foregoing operation is even facilitated in the case of cans or jars of soft drinks, which in the proximity of the rim (90) show a narrowing defining a shoulder. The flap (81) on the mouth is folded or brought down on the mouth of the receptacles (30) and the flap (84) on flap (81), in both cases the hinge paper making the narrow flaps (82) and (83), respectively. The application of adhesive in appropriate areas of the flaps (81), (79) and (84) fixes the formation of the device of the invention, which is shown completed in the example of FIG. 35.

The material utilized, cardboard or pasteboard, generally has a sufficient flexibility to produce the displacement of the flanges (85, 86) during the introduction of the mouths of the receptacles (30). However, the displacement can be facilitated by means of some cuts or passing splits (91) made on the marked lines which define the flanges (85, 86), for example in the positions illustrated in FIGS. 31, 32 and 33.

In FIGS. 36 to 41 another embodiment of the device of the invention, and of the cardboard or pasteboard sheets which compose the device, is presented. This form basically coincides with the above described embodiment in relation to FIGS. 31 to 35, so that the same numerical references are maintained and repetition of the characteristics which have already been described is avoided.

The principal difference in relation to the previously described embodiment lies in the openings (62) for the retention of receptacles, which show a circular contour and a second group of retention flanges (92) approximately the same as the retention flanges (85) and which are located diametrically opposite thereto. From the retention flanges (92) extend some flanges (93), which partially occupy the inside surface of the retention openings (62), and are intended to impede oscillation of rocking of the receptacles (30).

It is also observed that in this execution the openings for the retention of the receptacles (62) corresponding to each row are in tangential contact, and that the handle openings (80) occupy the spaces between the openings (62). This execution with openings in tangential contact is considered preferable, if it is understood that nothing would prevent the existence of an intermediate flap similar to the one designated with the reference number (79) in FIGS. 31 to 34.

Figure 37:
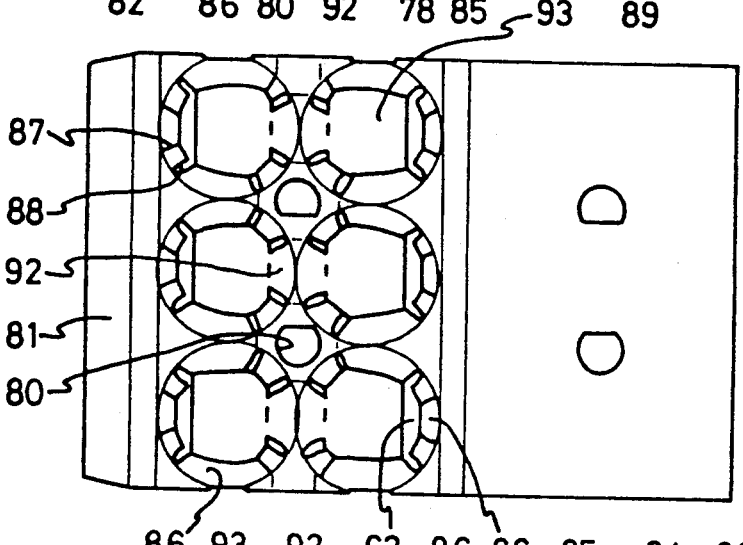
FIG. 37 is a view similar to FIG. 36 for six receptacles in two rows.
Figure 38:
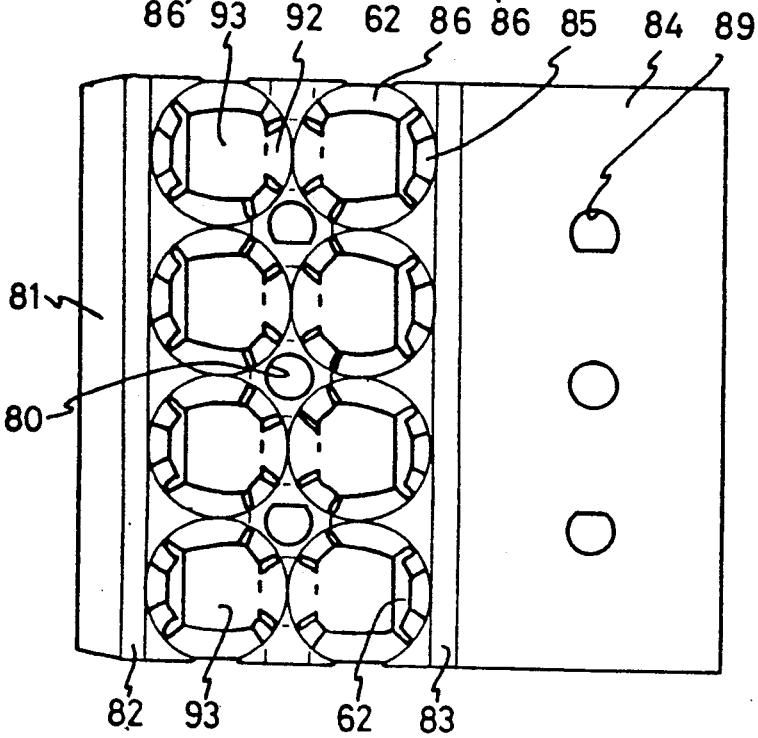
FIG. 38 is a view similar to FIGS. 36 and 37 for eight receptacles in two rows.
Figure 39:
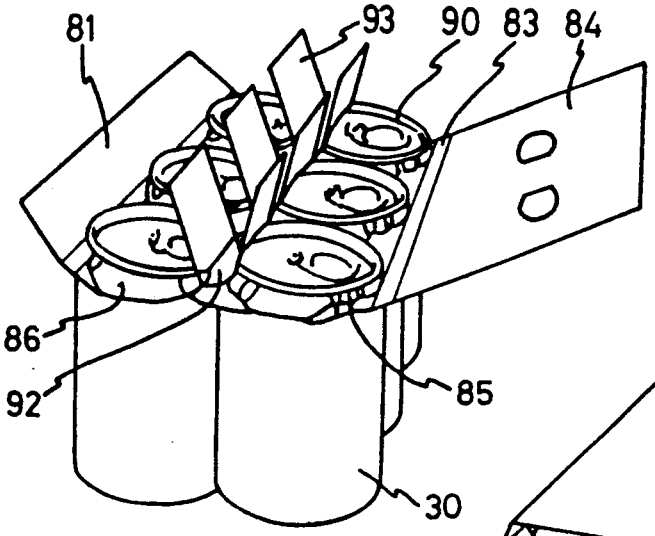
FIG. 39 is a view in perspective illustrating the application of the sheet represented in FIG. 37 on two rows of three receptacles.
Figure 40:
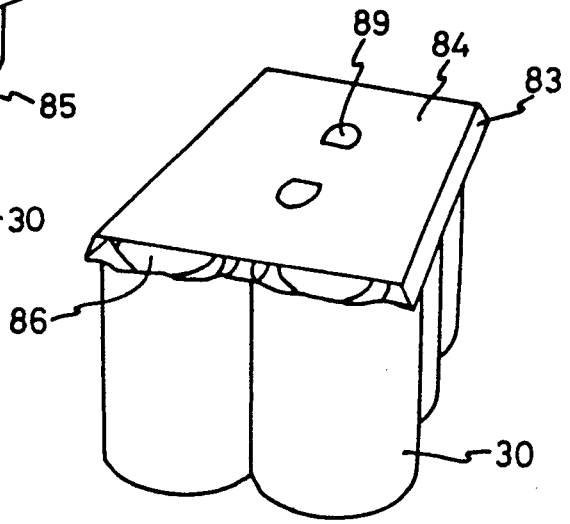
FIG. 40 is a view similar to FIG. 39 with the device according to the invention already shaped.
Figure 41:
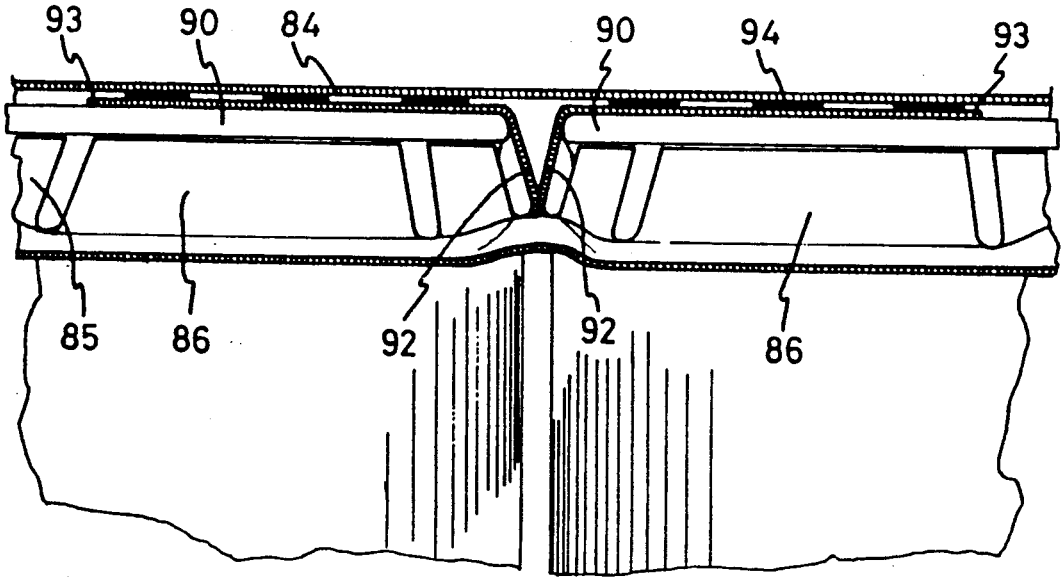
FIG. 41 is a detail in partial section illustrating the union and arrangement between elements of the device according to the invention represented in FIG. 40.

In FIG. 39 a phase of the formation of the device of the above embodiment is shown, formed from the sheet of FIG. 37 and utilizing everything stated in relation to FIG. 34. Also, it will be observed that in FIG. 40 the device of the invention is shown already completed and that, at least externally, it has an aspect similar to the one represented in FIG. 35

As indicated previously, the flaps (93) have the function of preventing or making less likely the oscillation or rocking of the receptacles (30) supported, especially toward the outside of the device. The way in which the flaps (93) fulfill this function will be understood from the detail illustrated in FIG. 41.

In that figure it can be observed that the flanges (92), instead of being anchored in the rim (90) of the receptacles (30) as happens with the flanges (85, 86), surround that rim, and the flaps (93) which extend from them are adhered to the inside face of the flap (84) by means of one or more adhesive layers (94). In this way, displacement or oscillation of the receptacles (30) is prevented due to their proximity or contact, while the displacement or oscillation in separation of the receptacles (30) is prevented or made significantly less likely by the stopping effect when the flanges (92) make against the rims (90).

It is understood from the previous description that the flaps (93) may totally or partially occupy the inside surface of the retention openings (62) and adopt a similar or different form at the inside surface of the retention openings (62).

In all the embodiments described, a smooth surface is provided which covers the mouth of the receptacles, as well as lateral surfaces, also smooth in some of the embodiment. These surfaces are easily used for printing information about the product in the receptacles, including the co-called bar code. Likewise, in all the embodiments described, a very resistant support and transport device is provided, even for a relatively high number of receptacles, whether or not the handle arrangements are provided. Also, in all the embodiments described, the folding of the cardboard which forms the devices and the incorporation of the receptacles is very simple, so that it becomes very easy to relegate this operation to a machine.

I claim:

1. A device for supporting and transporting a group of receptacles, comprising:

a lower panel for the retention of the receptacles, said lower panel having a plurality of circular openings defined therein by alternating two lines of weakness and two cut lines in a circle in said lower panel for each said opening receiving the receptacles therethrough, said openings having a plurality of flanges integral with said lower panel, said flanges extending into the area of said openings from said lines of weakness and said flanges having the form of concavely curved circular segments; and an upper panel connected to said lower panel covering the receptacles held in said openings, said upper panel comprising a smooth rectangular surface extending over said lower panel.

2. The device of claim 1, wherein said openings in said lower panel, defines by said lines of weakness and said cut lines, are each in tangential contact with at least one other said opening.

3. The device of claim 1, wherein said lines of weakness and said cut lines defining each said opening have a transition zone therebetween, said transition zone comprising a substantially semi-circular cut opening toward the inside of its said opening.

4. The device of claim 1, wherein said lines of weakness defining said openings in said lower panel, from which extend said flanges, have cuts spaced and extending along said lines of weakness.

5. The device of claim 1, wherein said upper panel has a handle thereon.

6. The device of claim 1, and further comprising a side panel connected to said upper panel at least partially covering one side of the receptacles.

7. The device of claim 1, wherein said side panel is joined by an adhesive to the side of the receptacles.

8. The device of claim 7, wherein said side panel is joined by an adhesive to the side of the receptacles.

9. The device of claim 1, wherein a tear line extends across said panels in a direction transverse to a line connecting the centers of said openings.

10. The device of claim 1, wherein said openings, defined by said lines of weakness having said flanges extending therefrom and said cut lines, have open space except at said flanges.

11. A device for supporting and transporting a group of receptacles comprising:

a pair of lower panels for the retention of the receptacles disposed adjacent to each other, each said lower panel having a plurality of circular openings defined therein by alternating two lines of weakness and two cut lines in a circle in said lower panel for each said opening, the receptacles being received through said openings, each said cut line extending along the perimeter of said circle, said openings in each said lower panel being aligned along an axis and said openings having flanges in the form of concavely curved circular segments extending therein from said lines of weakness; and an upper panel for covering the receptacles, said upper panel having a smooth rectangular surface extending over said lower panels and a handle.

12. The device of claim 11, wherein said axially aligned openings in each said lower panel, defined by said lines of weakness and said cut lines, are each in tangential contact with at least one another said opening.

13. The device of claim 11, wherein said lines of weakness and said cut lines defining each said opening have a transition zone therebetween, said transition zone comprising a substantially semi-circular cut opening toward the inside of its said opening.

14. The device of claim 11, wherein said lines of said weakness defining said openings in said lower panels, and from which extend said flanges, have cuts spaced and extending along said lines of weakness.

15. The device of claim 11, and further comprising a side panel connected to said upper panel at least partially covering one side of the receptacles.

16. The device of claim 11, wherein a tear line extends across said panels in a direction transverse to a line connecting the centers of said openings.

17. The device of claim 11, wherein said openings, defined by said lines of weakness having said flanges extending therefrom and said cut lines, have open space except at said flanges.

18. A sheet for the formation of a device for supporting and transporting a group of receptacles, said sheet having a substantially rectangular base having a plurality of spaced folding lines thereon defining two end panels and a central panel therebetween, said central panel having a plurality of openings therein for the retention and support of receptacles aligned axially along said central panel, each said opening being defined by alternating two lines of weakness and two cut lines in a circle in said central panel to form a circular contour of each said opening, each said cut line extending along the perimeter of said circle, each said opening having flanges, integral with said central panel, extending therein from said lines of weakness, said flanges having the approximate form of concavely curved circular segments, wherein said end panels are substantially rectangular and can be superimposed over said central panel and joined by an adhesive to form an upper panel for covering receptacles held by said central panel.

19. The sheet of claim 18, wherein said openings in said central panel, defined by said lines of weakness and said cut lines, are each in tangential contact with at least one other said opening.

20. The device of claim 18, wherein said lines of weakness and said cut lines defining each said opening have a transition zone therebetween, said transition zone comprising a substantially semi-circular cut opening toward the inside of its said opening.

21. The sheet of claim 18, wherein said lines of weakness defining said openings in said central panel, and from which extend said flanges, have cuts spaced and extending along said lines of weakness.

22. The sheet of claim 18, wherein two said folding lines are provided between each said end panel and said central panel having said openings therein defining a pair of narrow panels between said end panels and said central panel.

23. The sheet of claim 18, and further comprising a side panel connected to a said end panel by a folding line for at least partially covering one side of receptacles to be held by said central panel.

24. The sheet of claim 18, wherein a tear line extends across said panels in a direction transverse to a line connecting the centers of said openings.

25. A sheet for the formation of a device for supporting and transporting a group of receptacles, said sheet having a substantially rectangular base having a plurality a spaced folding lines thereon defining two end panels, two intermediate panels between said end panels and two central panels between said intermediate panels, each said intermediate panel having a plurality of axially aligned openings of circular contour for the retention and support of receptacles, each said opening being defined by alternating two lines of weakness and two cut lines in a circle in said intermediate panel to form the circular contour of each said opening, each said opening having flanges, integral with said intermediate panel, extending therein from said lines of weakness, said flanges having the approximate form of concavely curved circular segments, wherein said end panels are substantially rectangular and can be superimposed over said intermediate panels and joined by adhesive to form an upper panel for covering receptacles to be held by said intermediate panels, and wherein said central panels each have an opening therein for forming a handle when said central panels are folded together.

26. The sheet of claim 25, wherein said opening in said intermediate panels, defined by said lines of weakness and said cut lines, are each in tangential contact with at least one other said opening.

27. The device of claim 25, wherein said lines of weakness and said cut lines defining each said opening have a transition zone therebetween, said transition zone comprising a substantially semi-circular cut opening toward the inside of its said opening.

28. The sheet of claim 25, wherein said lines of weakness defining said openings in said intermediate panels, and from which extend said flanges, have cuts spaced and extending along said lines of weakness.

29. The sheet of claim 25, wherein two said folding lines are provided between said end panel and each said intermediate panel, defining a pair of narrow panels between said end panels and said intermediate panels.

30. The sheet of claim 25, and further comprising a side panel connected to a said end panel by a folding line for at least partially covering one side of receptacles to be held by said central panel.

31. The sheet of claim 25, wherein a tear line extends across said panels in a direction transverse to a line connecting the centers of said openings.

32. A device for supporting and transporting a group of receptacles, comprising:

a lower panel for the retention of receptacles, said lower panel having two rows of at least two openings defined therein for retaining receptacles, said openings in each said row being aligned along an axis, and each said row being separated from the other said row by a smooth lower panel portion, said smooth lower panel portion comprising a handling arrangement, wherein each said opening is partially circularly shaped and has a diameter at least equal to the diameter of a receptacle to be supported thereby, each said opening further having first flanges radially inwardly projecting from its edge for retaining a receptacle in said opening, said first flanges being disposed diametrically opposite to said smooth lower panel portion separating said rows, second unitary retention flanges extending on each side of said first flanges toward said smooth lower panel portion, said second retention flanges being substantially shaped as circular concave segments, and U-shaped cuts separating said first flanges from said second flanges; and an upper panel having a substantially smooth rectangular shape for covering receptacles held by said lower panel, said upper panel having a handling arrangement coincident in position with said handling arrangement of said smooth lower panel portion.

33. The device of claim 32, wherein said openings in each said row of said lower panels are each in tangential contact with at least one other said opening in its respective said row.

34. The device of claim 32, wherein said lower panel has a cut along the point of tangential contact between two said openings in a said row.

35. The device of claim 32, wherein said handling arrangement in both said smooth lower panel portion and said upper panel comprises aligned openings having a diameter suitable for engagement by a finger.

36. A device for supporting and transporting a group of receptacles, comprising:

a lower panel for the retention of receptacles, said lower panel having two rows of at least two openings defined therein for retaining receptacles, said openings in each said row being aligned along an axis, said openings of each said row being in tangential contact with said openings of the other said row, a handling arrangement being defined between said openings and said rows in said lower panel, each said opening having a circular contour with a diameter sized for receipt of a receptacle, first flanges projecting radially inwardly from opposite sides of said opening, second unitary flanges located between said first flanges said second retention flanges being substantially shaped as circular concave segments, and U-shaped cuts separating said first flanges from said second flanges, and each said opening in a said row further having a flap extending therein from said first flanges adjacent the other said row; and an upper panel having a substantially smooth rectangular shape for covering receptacles held by said lower panel, said upper panel having a handling arrangement coincident in position with said handling arrangement of said lower panel, said flaps of said openings being adhered to the lower surface of said upper panel.

37. The device of claim 36, wherein openings in each said row of said lower panels are each in tangential contact with at least one other said opening in its respective said row.

38. The device of claim 37, wherein said lower panel has a cut along the point of tangential contact between two said openings in a said row.

39. The device of claim 36, wherein said handling arrangements in both said lower panel and said upper panel comprises aligned openings having a diameter suitable for engagement by a finger.

40. The device of claim 36, wherein said flaps correspond substantially in size and shape to the size and shape of said openings.

41. A sheet for the formation of a device for supporting and transporting a group of receptacles, said sheet having a substantially rectangular base having a plurality of spaced folding lines thereon defining two end panels, one said end panel being larger than the other said end panel and having at least one centered opening, whereby an upper panel can be formed by superimposing and joining the panel with an adhesive, two narrow intermediate panels between said end panels for forming sides of the device, two central panels for forming a lower panel, each said central panel having a row of at least two axially aligned receptacle retention openings, each said opening being partially circularly shaped and having a diameter at least equal to the diameter of a receptacle to be supported thereby, each said opening further having first flanges for retaining receptacles radially inwardly projecting from its edge and second unitary flanges extending on each side of said first flanges, said second retention flanges being substantially shaped as circular concave segments, and U-shaped cuts separating said first flanges from said second flanges, and a narrow panel between said central panels having at least one centered handle opening for positional coincidence with said opening of the one said end panel.

42. The sheet of claim 41, wherein said openings in the one said end panel and said narrow panel are sized for the receipt of a finger.

43. A sheet for the formation of a device for supporting and transporting a group of receptacles, said sheet having a substantially rectangular base having a plurality of spaced folding lines thereon defining two end panels, one said end panel being larger than the other said end panel and having at least one centered opening, whereby and upper panel can be formed by superimposing and joining the panel with an adhesive, two narrow intermediate panels between said end panels for forming sides of the device, two central panels for forming a lower panel, each said central panel having a row of at least two axially aligned receptacle retention openings, said opening in each said row being in tangential contact with said openings of the other said row, said rows and said opening having a space therebetween, said space having at least one handling opening therein, each said opening having a circular contour with a diameter sized for receipt of a receptacle, first flanges projecting radially inwardly from opposite sides of said opening, second unitary flanges located between said first flanges, said second retention flanges being substantially shaped as circular concave segments, and U-shaped cuts separating said first flanges from said second flanges, and each said opening in a said row further having a flap extending therein from said first flanges adjacent the other said row.

44. The sheet of claim 43, wherein said handling opening and said opening in the one said end panel are sized for the receipt of a finger.

45. The sheet of claim 43, wherein said flaps correspond substantially in size and shape to the size and shape of said openings of said central panels.

46. The sheet of claim 43 or 41, wherein each said openings of each said row is in tangential contact with at least one other said opening from its said row.

47. The sheet of claim 46, wherein cuts are provided in said central panels at the points of tangential contact between said openings.

* * * * *